US006171129B1

(12) United States Patent
Phillips

(10) Patent No.: US 6,171,129 B1
(45) Date of Patent: Jan. 9, 2001

(54) LOCKING ELECTRICAL ADAPTER

(76) Inventor: Duane A. Phillips, 617 Chestnut St., Aiken, SC (US) 29803

( * ) Notice: Under 35 U.S.C. 154(b), the term of this patent shall be extended for 0 days.

(21) Appl. No.: 09/298,512

(22) Filed: Apr. 23, 1999

(51) Int. Cl.[7] ..... H01R 4/50
(52) U.S. Cl. ..... 439/346; 439/263
(58) Field of Search ..... 439/104, 263, 439/265, 349, 953, 638

(56) References Cited

U.S. PATENT DOCUMENTS

| | | | |
|---|---|---|---|
| 1,404,098 | | 5/1922 | Dennis . |
| 1,536,688 | | 1/1925 | Osborn . |
| 1,660,290 | | 2/1928 | Benjamin . |
| 2,261,615 | | 11/1941 | Cornwell . |
| 2,408,551 | | 10/1946 | Frank . |
| 2,436,586 | | 2/1948 | Mangold . |
| 3,440,591 | * | 4/1969 | Whalen . |
| 3,710,304 | | 1/1973 | Warner et al. . |
| 4,544,216 | | 10/1985 | Imhoff . |
| 4,627,681 | | 12/1986 | Hong . |
| 4,700,997 | | 10/1987 | Strand . |
| 4,867,697 | | 9/1989 | Borges . |
| 4,909,697 | | 3/1990 | Long . |
| 5,069,634 | | 12/1991 | Chiarolanzio . |
| 5,108,301 | | 4/1992 | Torok . |
| 5,129,836 | | 7/1992 | Ursich . |
| 5,197,897 | | 3/1993 | Torok . |
| 5,393,239 | | 2/1995 | Ursich . |
| 5,427,543 | | 6/1995 | Dynia . |
| 5,480,318 | | 1/1996 | Garrison . |
| 5,551,884 | | 9/1996 | Burkhart, Sr. . |

* cited by examiner

*Primary Examiner*—Khiem Nguyen
(74) *Attorney, Agent, or Firm*—Maria Reichmanis

(57) ABSTRACT

An electrical adapter with dual, user-operable locking mechanisms for attachment to a standard electrical plug and outlet, one for securing the prongs of the adapter into a socket or wall-mounted outlet or receptacle and the other for securing a standard electrical plug thereto. The two mechanisms work independently of each other to secure the male and female sides of a conventional plug-and-socket combination together. The adapter can be used with existing appliances, hand tools, extension cords, and electrical outlets without the need for rewiring. The male and female ends of the adapter may be connected by an electrical cord to replace a conventional extension cord; alternatively, the locking mechanism can be built into replacement electrical plugs or a wall outlet having approximately the same dimensions as conventional outlets. Use of the invention eliminates the annoying problem of power interruptions to appliances, hand tools, and the like that occur when a plug is accidentally pulled loose from its socket. The invention also provides extra safety from electrocution and reduces spark hazards by locking the plug and socket together to help prevent accidental dislodging.

22 Claims, 4 Drawing Sheets

LOCKING ELECTRICAL ADAPTER

BACKGROUND OF THE INVENTION

1. Field of the Invention

The present invention relates to a locking connector and adapter for interfacing a standard electrical plug to a receptacle. In particular, the present invention relates to an adapter having two independent, releasable locking mechanisms, the first mechanism for securing the prongs of an electrical plug therein and the second mechanism for securing the adapter to a standard receptacle.

2. Discussion of Background

Inadvertent removal of an electrical plug from a socket, outlet strip, or wall-mounted receptacle has been a matter of concern since electrical appliances became common. Almost everyone who has ever used a hand mixer, vacuum cleaner, power tool, or other hand-manipulated electrical appliance has accidentally pulled the plug out of a wall outlet. At best, such interruptions are annoying and inconvenient for the user, who has to stop work to re-insert the plug into the outlet before he can continue. In some situations, replacing the plug significantly disrupts work in progress, as when a construction worker has to climb down a ladder to replace the plug, then climb back up to resume work. Over time, repeated stress on the plug may damage the conductors to the point that the power cord must be replaced. In some situations, damaged plugs and loose connections can lead to potentially dangerous sparking and electrical shorts.

A wide variety of locking electrical adapters and connectors, for wall outlets, plugs, sockets, extension cords and the like, have been developed in response to these concerns. Many of these devices have slidable actuators and/or locking blocks for securing the prongs of an electrical plug into a wall outlet. Burkhart, Sr. provides such a device, which has a lockable, spring-loaded socket with a pair of hinged jaws for retaining an electrical plug in place (U.S. Pat. No. 5,551,884). The plug can be released from the socket by simply pushing it inwards, then allowing it to be thrust out under spring pressure.

In U.S. Pat. No. 5,108,301, Torok discloses a locking cord connector that includes a non-conductive housing, a pair of conductors each having a male and a female electrical contact (each with leaf-type springs), two spring-loaded locking mechanisms with slide blocks, and a slidable actuator. The first locking mechanism locks the male electrical contacts to a receptacle; the second locks the female contacts to another plug (such as a conventional plug of an electrical appliance). Long shows a socket with a releasable locking mechanism (U.S. Pat. No. 4,909,749). His device includes a housing that contains transversely spaced contact bars and a cam-operated clamp that locks the contact bars and the prongs of a plug together to deter removal.

Borges discloses a self-locking electrical connector consisting of a male plug and a female receptacle (U.S. Pat. No. 4,867,697). The receptacle includes a selflocking mechanism with a spring-loaded locking block which automatically locks the two parts together after insertion of the prongs of the male plug.

Strand's connector, described in U.S. Pat. No. 4,700,997, is designed for attaching a flat electrode (such as an EEG electrode) to a cable. The connector includes resilient upper and lower jaws that are joined at their respective rear ends by a flexible, resilient spring, and a slidable actuator that compresses the jaws together to hold a flat electrode in place.

Hong's device (U.S. Pat. No. 4,627,681) includes a movable wedge for pressing the male and female contacts together, whereas Imhoffs plug (U.S. Pat. No. 4,544,216) has a locking ground prong with a longitudinal "V"-shaped or "U"-shaped recess that holds a slidable, spring-loaded locking member. Warner, et al. provide a locking electric receptacle that includes a push-button rod and toggle mechanism for frictionally engaging the prongs of a male plug (U.S. Pat. No. 3,710,304).

Mangold (U.S. Pat. No. 2,436,586) and Cornwell (U.S. Pat. No. 2,261,615) provide plugs that can be laterally expanded upon insertion into a socket in order to maintain good electrical contact. Both devices include slide actuators for moving the elements that expand the prongs. Osborn's connector has a coupler with two notched tongues, teeth shaped to engage the tongues, and a transverse slidable actuator for locking it into position (U.S. Pat. No. 1,536,688).

Rotatable actuators for electrical devices are also known in the art. Torok discloses such an actuator in U.S. Pat. No. 5,197,897. His device has a non-conductive housing, a pair of conductors, two spring-loaded locking mechanisms with slide blocks, and a slidable actuator. One of the locking mechanisms locks the male electrical contacts to a receptacle; the other locks the female contacts to another plug.

Other designs include Garrison's three-prong plug with a hollow, locking ground prong (U.S. Pat. No. 5,480,318). A spring-loaded catch that engages the front wall of a socket or wall outlet is attached to the prong. The catch can be released by pushing the spring in with a nonconducting rod. Dynia's locking connector (U.S. Pat. No. 5,427,543) includes two "U"-shaped connectors for receiving the prongs of an electrical plug. A sliding cam assembly activates a spring-loaded pin to compress the sides of the connectors and retain the prongs in place. Ursich provides a self-locking female electrical socket with an automatic release mechanism and two balls that engage the holes in the prongs to secure them in place (U.S. Pat. Nos. 5,393,239 and 5,129,836). The actuator consists of a shaft with a cut-out area that permits the user to engage/disengage the balls mounted in the body of the device.

Benjamin (U.S. Pat. No. 1,660,290) shows an electrical plug and outlet combination wherein the plug is fitted with hooks and latching fingers that mechanically connect it to corresponding openings in the outlet plate. The fingers can be disengaged by a thumb screw to permit removal of the plug from the socket. Frank's self-latching electric plug has a movable arm with a lug at one end and a hook at the other end (U.S. Pat. No. 2,408,551). When the arm is in a neutral position, the plug can be inserted into (or removed from) a matching socket; after insertion, the arm is moved into a locking position where the hook latches onto a shoulder to secure the plug in place.

Dennis provides a swivel coupling lock with spring hooks that engage corresponding grooves in the prongs of an electrical plug (U.S. Pat. No. 1,404,098). Two buttons can be pushed inwards to disengage the hooks and permit removal of the plug. Chiarolanzio's snap lock extension cord and power tool connector (U.S. Pat. No. 5,069,634) positively engages a plug to an extension cord or wall outlet having two outwardly-projecting flexible fingers with locking tabs. The matching appliance plug has corresponding openings on its face and sides. As the plug is pushed into the outlet, the flexible fingers enter the openings; the locking tabs are biased into the side openings to positively engage the plug and receptacle together.

Notwithstanding the wide variety of designs encompassed by the prior art, many presently-available locking connectors and adapters are relatively complex, correspondingly difficult and expensive to manufacture, and too delicate and breakage-prone for long-term household or industrial use. Some locking connectors require special tools to disengage and remove a locked plug. Others can be used only with specially-designed sockets or wall outlets; these cannot be used with standard, general service outlets of the types prescribed by the National Electrical Code (NEC) or the American National Standards Institute (ANSI).

There is a continuing need for locking electrical adapters and connectors which can be used to releasably secure a plug to a conventional extension cord socket, wall receptacle, or the like, including receptacles that meet NEC and ANSI standards. Such devices should be simple and easy to manufacture, aesthetically pleasing to consumers, easy to use, and further the safe and uninterrupted use of electrical appliances and tools that frequently require the dragging or hanging portions of the power cord (or extension cord) during use.

SUMMARY OF THE INVENTION

According to its major aspects and broadly stated, the present invention includes an electrical adapter having a male end, a female end, and two user-operable locking mechanisms. The two locking mechanisms work independently of each other to secure the male and female sides of a conventional plug-and-socket combination together: the first locking mechanism secures the prongs of the male end of the adapter in a standard socket or wall-mounted outlet; the second secures the prongs of a standard electrical plug in the female end. Use of the invention largely eliminates the annoying problem of power interruptions to appliances, hand tools, and the like that occur when a plug is accidentally pulled loose from a socket. The invention also provides an added margin of safety from electrocution and reduces spark hazards by securing the plug and socket together to help prevent accidental dislodging.

An important feature of the present invention is its simplicity and versatility. The adapter is simple to manufacture and operate, and can be used to interface an electrical plug to a conventional socket such as the familiar US 15A-125VAC type of socket or other standard types. Thus, it can be used with existing appliances and tools without the need for rewiring. In another embodiment of the invention, the male and female ends of the adapter are connected by an electrical cord to form an extension cord, thereby replacing conventional electrical cords which can easily be pulled away from an outlet while in use. In yet another embodiment, the locking mechanism can be built into an appliance or a wall outlet having approximately the same dimensions as conventional outlets (for purposes of this specification, the terms "outlet" and "receptacle" are used interchangeably). The outlet can substitute for other types of outlet in new construction or renovation; alternatively, homeowners can install it in outlets that are frequently used for appliances, tools, and the like.

Another feature of the present invention is the first locking mechanism, which includes a first slidable actuator (also termed a "locking block"). The user slides the first actuator forwards to compress a pair of springs against the prongs that extend from the male end of the adapter, allowing the prongs to be inserted into a standard electrical connector or wall outlet. Sliding the first actuator backwards releases the springs, which then move outwards in a generally vertical plane to engage the edges of the outlet and thereby deter accidental removal of the adapter. In a preferred embodiment of the invention, the tips of the prongs are shaped to accommodate the springs, thereby providing stability and helping prevent accidental dislodging from an outlet.

Still another feature of the present invention is the second locking mechanism, which includes a second slidable actuator operable to secure the prongs of a standard electrical plug into the female end of the adapter. The second mechanism includes slidable wedge and a retainer assembly. Sliding the second actuator rearwards closes the retainer assembly to secure the prongs in the recesses of the female end; sliding it forwards releases the retainer assembly, allowing easy insertion and removal of the plug.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
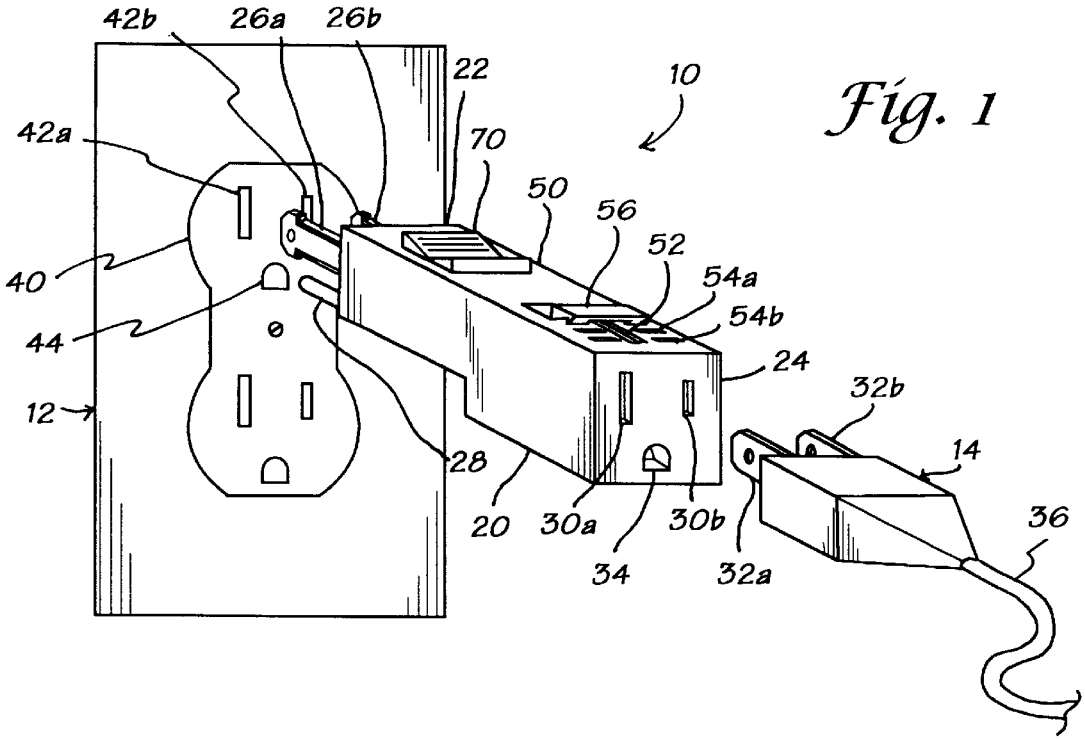
FIG. 1 is a perspective view showing a locking adapter according to the present invention, with a wall-mounted outlet at the male end of the adapter and a conventional electrical plug at the female end.

In the following detailed description, reference numerals are used to identify structural elements, portions of elements, surfaces and areas in the drawings. It should be understood that like reference numerals are intended to identify the same structural elements, portions or surfaces consistently throughout the several drawing figures, as such elements, portions or surfaces may be further described or explained by the entire written specification. As used in the following description, the terms "horizontal," "vertical," "left," right," "up," "down," as well as adjectival and adverbial derivatives thereof (e.g., "horizontally," "rightwardly," "upwardly," etc.) refer to the relative orientation of the illustrated structure as the particular drawing figure faces the reader. Similarly, the terms "inwardly" and "outwardly" refer to the orientation of a surface of revolution relative to its axis.

Referring now to FIG. 1, there is shown a locking electrical adapter or connector 10 according to a preferred embodiment of the present invention, positioned for use with a typical wall-mounted receptacle 12 and an electrical plug 14. Receptacle 12 and plug 14 are standard, general-purpose devices of the two-pole, two-wire or two-pole, three-wire type as disclosed in NEC and ANSI standards or specifications. However, it should be understood that the principles of the invention as described below are also applicable to plugs and receptacles of other designs and configurations.

Adapter 10 has a body 20 made of electrically non-conducting material, with a distal, male end 22 and a proximal, female end 24. Prongs 26*a,* 26*b* and ground connector 28 extend forwards of distal end 22; proximal end 24 has corresponding slots 30*a,* 30*b* for receiving prongs 32*a,* 32*b* of plug 14, and a slot 34 for receiving the plug ground connector (if present).

Plug 14 may be a two-pronged or three-pronged plug, either polarized or unpolarized (a polarized, two-pronged plug 14 is shown in FIG. 1), connected to an appliance, hand tool, or the like by a power cord 36. Receptacle 12 has at least one socket 40 with slots 42*a,* 42*b* for receiving the prongs of an electrical plug and a slot 44 for a plug ground connector (receptacle 12 may, of course, have several sockets 40, arranged in any convenient fashion). Slots 42*a,* 42*b,* like slots 30*a,* 30*b* of adapter 10, may be configured for use with either polarized or unpolarized plugs. It will be understood that receptacle 12 and plug 14 illustrate the use of adapter 10; receptacle 12 and plug 14 do not in and of themselves form part of the invention.

An upper surface 50 of adapter 10 has a longitudinal slot 52 and at least two paired, transverse slots 54*a,* 54*b* formed therein. A first actuator or locking block 56 is slidable in slot 52 to engage selected slots of slots 54*a,* 54*b,* . . . to secure prongs 32*a,* 32*b* of plug 14 in adapter 10, as will be described further below.

Prongs 26*a,* 26*b* extend outwards from slots 58*a,* 58*b* in distal end 22 of adapter 10. The forward ends of prongs 26*a,* 26*b* are preferably formed with recesses or shoulders 60*a,* 60*b* shaped to accommodate two pairs of approximately "L"-shaped springs 62*a,* 62*b*. In a closed or neutral position shown in FIG. 2A, springs 62*a,* 62*b* engage prongs 26*a,* 26*b,* respectively, so that prongs 26*a,* 26*b* (with ground connector 28, if present) can readily be inserted into the corresponding slots of a conventional socket 40. Once inserted, the user slides a second actuator or locking block 70 backwards to move springs 62*a,* 62*b* in an approximately vertical plane to an open position (shown in FIG. 2B), wherein tips 72*a,* 72*b* engage the upper edges of slots 42*a,* 42*b* to secure adapter 10 to outlet 40.

Above-described adapter 10 includes an optional ground connector 28. If desired, connector 28 may include a pivot 80 that allows the user to rotate the connector by 90°–180° (or thereabouts), thereby moving connector 28 out of the way so that the adapter can be used with an ungrounded outlet.

Figure 3:
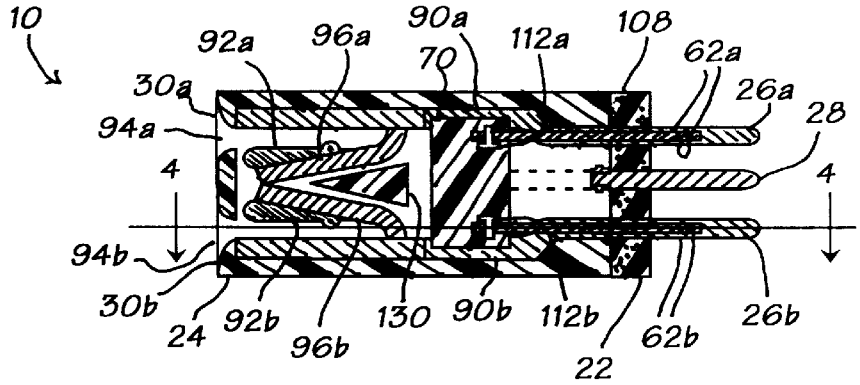
FIG. 3 is a cross-sectional view of the adapter of FIG. 1 taken along the lines 3—3 of FIG. 2A.
Figure 4:
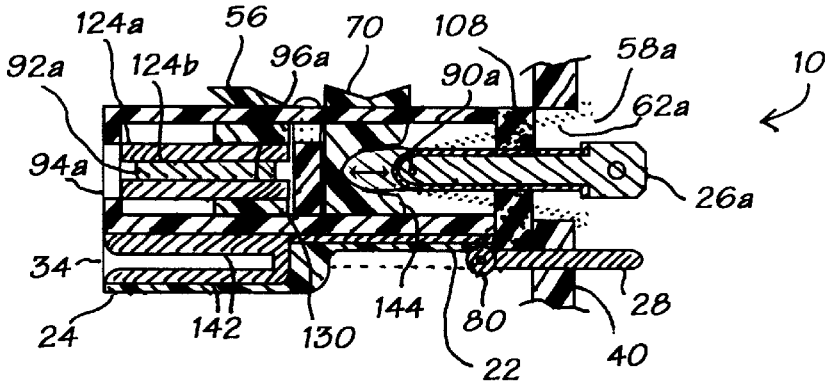
FIG. 4 is a cross-sectional view taken along the lines 4—4 of FIG. 3, showing the action of the retaining springs and the ground connector of the first locking block when the adapter is inserted into an electrical outlet.

FIGS. 3 and 4 illustrate the operation of adapter 10 when used with a typical plug 14 and socket 40 (for clarity, connections to household electrical wiring are not shown). Adapter 10, with spring pairs 62*a,* 62*b* in the closed, neutral position, is inserted into outlet 40 so that prongs 26*a,* 26*b* are in slots 42*a,* 42*b,* respectively, and ground connector 28 is in slot 44. For ungrounded outlets, connector 28 is pivoted on pin 80, preferably by approximately 180°, to rest against a bottom 82 of adapter body 20. Indeed, body 20 may include a recess configured for receiving connector 28, such as a shouldered recess 84.

Figure 2A:
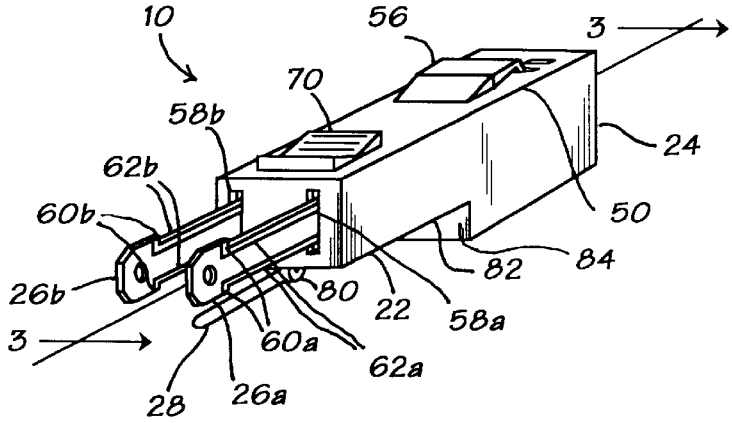
FIG. 2A is a perspective view of the adapter of FIG. 1, showing the retaining springs in a closed, neutral position.
Figure 2B:
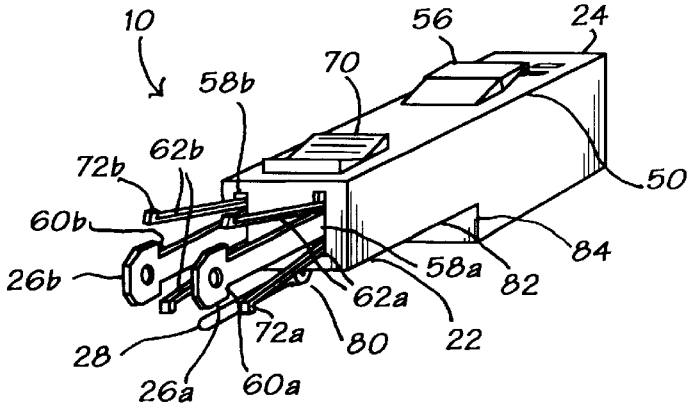
FIG. 2B is a perspective view of the adapter of FIG. 1, showing the retaining springs in an open, locking position.

To place spring pairs 62*a,* 62*b* in their closed position, the user slides locking block 70 forwards, pushing the springs inwards to a position where ends 72*a,* 72*b* substantially engage recesses 60*a,* 60*b* of prongs 26*a,* 26*b* as shown in FIG. 2A. After inserting adapter 10 into socket 40, the user slides block 70 backwards, releasing spring pairs 62*a,* 62*b* (the length of slot 106 limits the reciprocal movement of block 70). As block 70 moves backwards, the springs move outwards from prongs 26*a,* 26*b* to the open, locking position shown in FIG. 2B, so that ends 72*a,* 72*b* engage the upper edges of slots 42*a,* 42*b*. Ends 72*a,* 72*b* gently but firmly secure prongs 26*a,* 26*b* in position in slots 42*a,* 42*b,* thereby deterring accidental removal of adapter 10 from socket 40. It will be understood that springs 62*a,* 62*b* secure adapter 10 against everyday, accidental dislodging from socket 40. Adapter 10 may still be pulled away from outlet 40; however, any force sufficient to pull adapter 10 completely away from outlet 40 is greater than the forces normally exerted on extension cords, plugs, etc. during normal use of typical appliances and hand tools.

Figure 5:
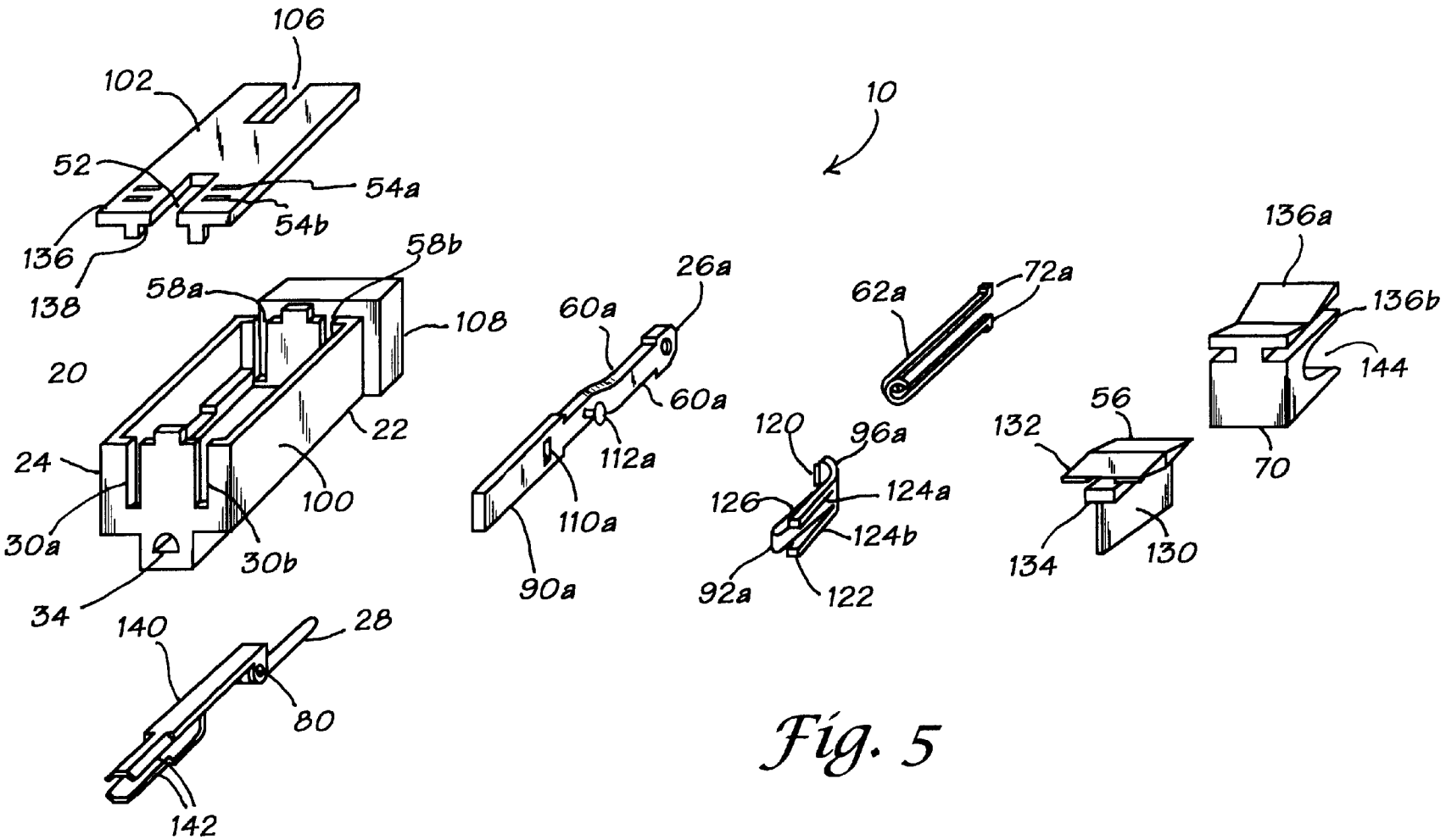
FIG. 5 is a perspective view of the components of the adapter of FIG. 1, with duplicate components omitted for clarity.

Adapter 10 includes a retaining assembly with two main conductors 90*a,* 90*b* that terminate in prongs 26*a,* 26*b,* and corresponding female "swing" conductors 96*a,* 96*b* (only conductors 90*a* and 96*a* are shown in FIGS. 4 and 5), both made of copper, copper alloy, or other suitable electrically-conducting material. Conductors 96*a,* 96*b* are positioned so as to define two recesses 94*a,* 94*b* adjacent to corresponding slots 30*a,* 30*b* (FIG. 3). When prongs 32*a,* 32*b* of plug 14 are inserted into recesses 94*a,* 94*b,* the user moves wedge-shaped block 56 backwards, towards proximal end 24 of adapter 10, to engage a selected pair of slots 54*a,* 54*b* that lock the block in position. A block 130 forces the ends of conductors 96*a,* 96*b* outwards, narrowing recesses 94*a,* 94*b* and thereby securing prongs 32*a,* 32*b* therein. The length of slot 52 serves to limit reciprocal movement of block 56.

Adapter 10 may have two or more pairs of slots 54*a,* 54*b,* . . . , the most inward pair defining the widest extent of recesses 94*a,* 94*b* and the most outward pair defining the narrowest extent of the recesses to accommodate different thicknesses of prongs 32*a,* 32*b*.

FIG. 5 illustrates the individual components of adapter 10 in a preferred embodiment of the invention (for clarity, only prong 26*a* and components associated therewith are shown; prong 26*b* and associated components are omitted). Adapter body 20 includes a hollow housing 100 having an interior shaped and dimensioned for holding prongs 26*a,* 26*b,* blocks 130, 70, etc. The interior of body 20 may include such recesses, projections, and so forth as may be deemed convenient for accommodating the various components of adapter 10. A lid 102 has formed therein at least two pairs of transverse slots 54*a,* 54*b,* first longitudinal slot 52 (for sliding wedge 130), and a second longitudinal slot 106 (for sliding block 70). If desired, a boot 108, of foam rubber or like material, may be attached to male end 22 to help maintain tension on spring pairs 62*a,* 62*b*. Boot 108, if present, also adjusts adapter 10 for use with outlets and receptacles of different depths and thicknesses.

Main conductor 90*a* has a slot 110*a* formed therein for attachment of conductor 96*a*. A pin, screw, or other suitable fastener 112*a* secures spring 62*a* to conductor 90*a*. Spring 62*a* is configured approximately as shown, with a pair of hooked tips 72*a* that engage shoulders 60*a* of prong 26*a* when adapter 10 is in the neutral position.

Conductor 96*a* has an end tab 120 that acts as a hinge when inserted into slot 110*a* of conductor 90*a*. A split end 122 has arms 124*a*, 124*b* that engage a locking wedge 130 of sidable block 56, and a tab 126.

Slide block 56 is shaped generally as shown, with a user-operable button portion 132 and a portion 134 that together form a pair of jaws that engage top surface 136 and bottom surface 138 of lid 102 as the block slides in slot 52. Block 56 is thereby received inside housing 100 for limited reciprocal movement in slot 52. In operation, wedge 130 (shown in cross-section in FIG. 3) forces ends 92*a*, 92*b* of conductors 96*a*, 96*b* inwards, narrowing recesses 94*a*, 94*b* and thereby securing the prongs 32*a* 32*b* of plug 14 therein.

Slide block 70 may include a first portion 136*a* and a second portion 136*b* that form a pair of jaws as described above for slide block 56; however, jaws 136*a*, 136*b* are not needed for proper function of block 70. An indentation 144, shaped approximately as shown in FIG. 5, engages and compresses springs 62*a* when block 70 is moved forwards (i.e., to the unlocked, closed position shown in FIG. 2A).

Ground connector 28 is pivotably attached to a conductor 140, which has an end 142 formed for receiving a ground connector of plug 14 (if present). Pivot 80 allows the user to conveniently swing connector 28 out of the way when using adapter 10 with ungrounded outlets.

The electrically-conducting components of adapter 10 (prongs 26*a*, 26*b*, ground connector 28, and so forth) are preferably made of standard gauge copper, copper alloy, or other suitable metal that meets applicable standards. Springs 62*a*, 62*b* are preferably made of spring steel, stainless steel, beryllium copper, or other electrically conducting or non-conducting materials that provides the desired durability and resilience. Housing 20, lid 102, and slide blocks 70, 130 may be made of any sturdy, durable, electrically non-conducting material such as hard plastic.

An adapter 10 according to the present invention may be a stand-alone device configured for use with a variety of electrical plugs and outlets, whether two-pronged or three-pronged, polarized or unpolarized. While adapter 10 is illustrated herein in an embodiment that conforms generally to present-day US standards, the components of adapter 10 may readily be adapted for other localities with different standards: the shapes and relative positions of prongs 26*a*, 26*b* and connector 28 can vary, as may the dimensions and materials of these and the other components of adapter 10. By way of example only, an adapter 10 may have spring pairs 62*a*, 62*b* that rest in slots formed in prongs 26*a*, 26*b* having a circular cross-section such as the standard plugs used in Europe, the Middle East, Asia, and parts of Africa. Alternatively, adapter 10 may be configured for use with plugs having two-angled blades such as those used in Australia and parts of New Zealand, or plugs with three flat blades used in England, Hong Kong, and parts of Africa. Adapter 10 is simple and easy to operate: indeed, slide blocks 56, 70 are suited for one-handed operation.

A locking adapter according to the present invention is simple to manufacture and easy to use. The adapter is versatile: it can be used to interface any standard electrical plug to any standard socket, including but not limited to the familiar US 15A-125VAC plugs and sockets. Depending on the number and configuration of the prongs, the invention can be used with polarized or nonpolarized outlets, or with two-prong or three-prong outlets.

Figure 6:
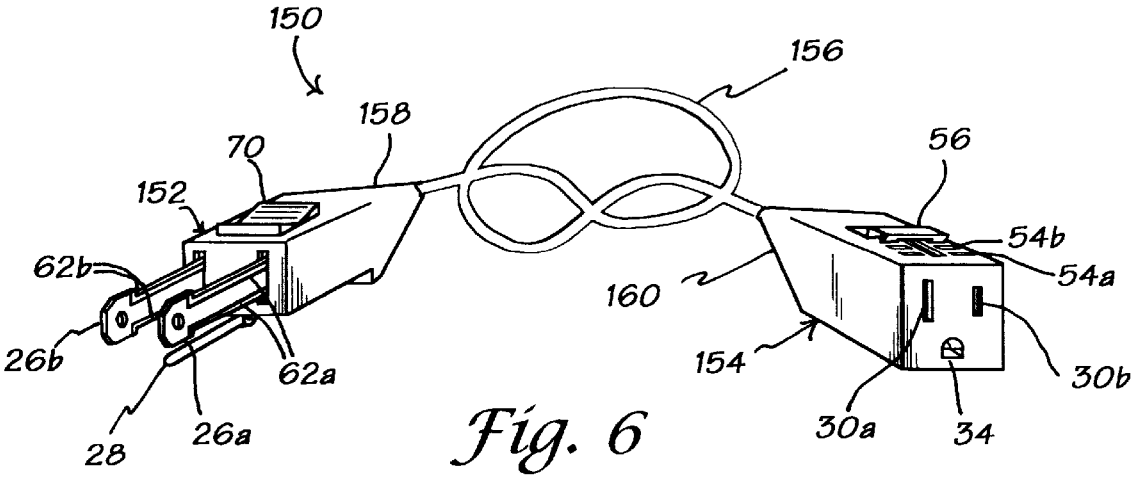
FIG. 6 shows an extension cord according to the present invention.

In one embodiment of the invention, the adapter can be used to interface existing appliances and tools to conventional outlets, eliminating the need for rewiring. Alternatively, an extension cord 150 has a male end 152 and a female end 154 connected by an electrical cord 156 (FIG. 6).

Male end 152, like male end 22 of above-described adapter 10, has two prongs 26*a*, 26*b* with corresponding pairs of springs 62*a*, 62*b*, a ground connector 28, and a locking block 70. Similarly, female end 154 includes slots 30*a*, 30*b*, 34 for receiving the prongs and ground connector of an electrical plug, a block 56 slidable in slot 52 to engage selected slots of slots 54*a*, 54*b*, . . . , and a nonconducting housing 160. The interior components of ends 152, 154 correspond to those of ends 22, 24 of above-described adapter 10, as shown in FIGS. 3–5. Cord 150 replaces conventional electrical cords which are all too easy to pull away from an outlet while in use. In still another embodiment of the invention, adapter 10 may be a "pass-through" type of connector having two male ends or two female ends.

Figure 7A:
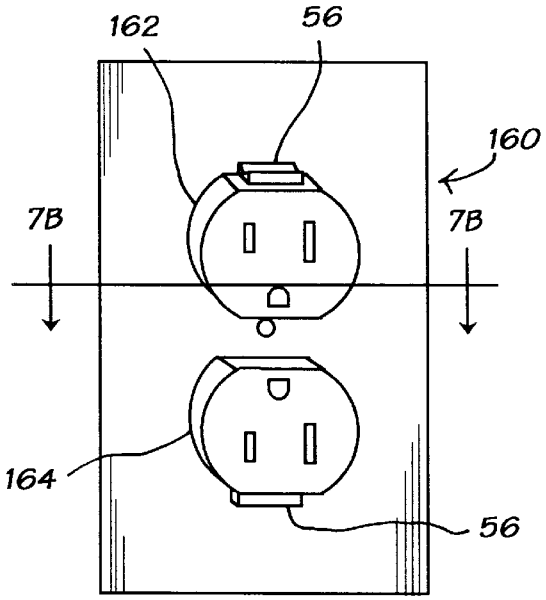
FIG. 7A shows a wall outlet according to the invention.
Figure 7B:
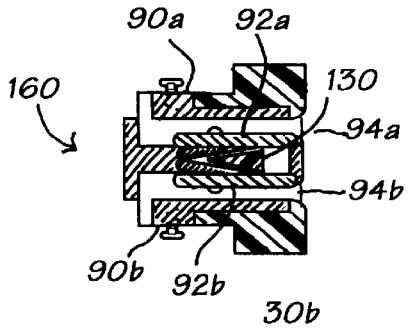
FIG. 7B is a cross-sectional view of the wall outlet of FIG. 7A, taken along the lines 7B—7B of FIG. 7A.

If desired, either the male or female end of adapter 10 can be built into a wall outlet having approximately the same dimensions as conventional outlets, for example, an outlet 160 with two female receptacles 162, 164, each having a user-operable locking block 56 (FIGS. 7A and 7B). Each receptacle 162, 164 has two main conductors 90*a*, 90*b*, together with conductors 92*a*, 92*b* that together define two recesses 94*a*, 94*b*. Moving block 56 backwards to engage a selected pair of slots 54*a*, 54*b*, . . . moves attached block 130 to force the ends of conductors 92*a*, 92*b* inwards, narrowing recesses 94*a*, 94*b* to secure the prongs of an electrical plug therein. Like above-described adapter 10, receptacles 162, 164 has at least two pairs of slots 54*a*, 54*b*, . . . to accommodate different thicknesses of prongs.

An outlet such as outlet 160 can substitute for other types of outlets in new construction; alternatively, homeowners can install it to replace conventional electrical outlets that are frequently used for appliances, hand tools, and the like.

Figure 8:
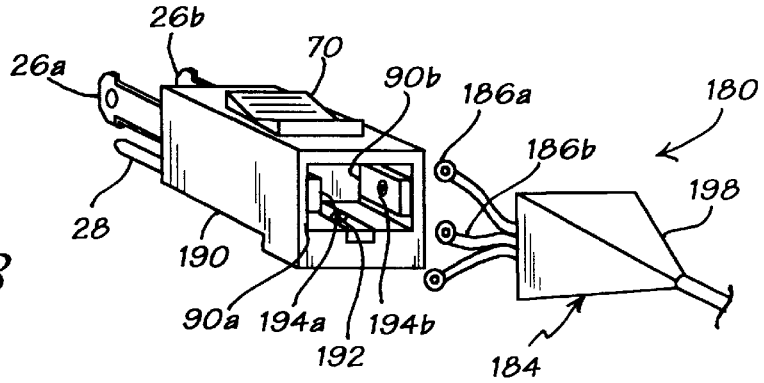
FIGS. 8 and 9 are perspective views of male and female plugs, respectively, each having a locking mechanism according to the invention.
Figure 9:
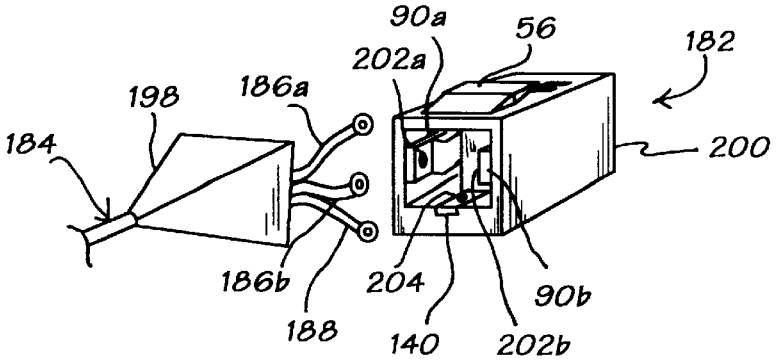

In still another embodiment of the present invention, male end 22 and female end 24 of adapter 10 can serve as replacement plugs for existing power cords and extension cords. FIGS. 8 and 9 show replacement plugs 180, 182 which can be retrofitted to a cord 184 having two connectors 186*a*, 186*b* and a ground connector 188.

Male replacement plug 180 has a body 190 of electrically non-conducting material, prongs 26*a*, 26*b* and a ground connector 28 extending forwards of body 190, a user-actuated block 70, and interior components as described above for male end 22 of adapter 10 (FIG. 8). When connectors 188*a*, 188*b* are attached to connectors 194*a*, 194*b* of conductors 90*a*, 90*b*, respectively, and connector 188 is attached to a ground connector 192, a housing 198 of cord 184 is flush against the proximal end of body 190.

Female replacement plug 182 has a body 200 of electrically non-conducting material, and a forward, distal end with slots (not shown) for receiving the prongs of an electrical plug (FIG. 9). The interior components of plug 182 correspond to those described above for female end 24 of adapter 10. In use, connectors 186*a*, 186*b* are attached to terminals 202*a*, 202*b* of conductors 90*a*, 90*b*, respectively; ground connector 188 is attached to a terminal 204 of conductor 140.

When plugs 180, 182 are connected to suitable cords 184 with their respective housings 198, 200 engaging corresponding housings 198, the result is a unitary structure that can be used in the same manner as a conventional power cord. Blocks 56, 70 are operable by the user to secure plugs 180, 182 in position, whether the plugs are used with wall outlets, built-in outlets on appliances or hand tools, or conventional electrical cords.

With respect to the above description of the invention, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing description is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. Thus, it will be apparent to those skilled in the art that many changes and substitutions can be made to the preferred embodiment herein described without departing from the spirit and scope of the present invention as defined by the appended claims.

What is claimed is:

1. A locking electrical adapter, said adapter comprising:

a housing of electrically non-conducting material;

a male electrical contact held in said housing, said male electrical contact including a first prong and a second prong, said prongs made of electrically conducting material;

first securing means for securing said male electrical contact in a female electrical receptacle, said first securing means including a first spring operably connected to said first prong, said first spring having a closed position wherein said first spring engages said first prong and an open position wherein an end of said first spring is spaced apart from said first prong, and a second spring operably connected to said second prong, said second spring having a closed position wherein said second spring engages said second prong and an open position wherein an end of said second spring is spaced apart from said second prong; and first actuating means for selectively actuating said first securing means to positively connect said male electrical contact to said receptacle, said first actuating means operable to move said first and second springs from said closed position wherein said prongs can be inserted into said receptacle to said open position wherein said first and second springs lock said adapter to said receptacle so that said first securing means resists inadvertent disconnection of said male electrical contact during normal use.

2. The adapter as recited in claim 1, further comprising:

a female electrical contact held in said housing;

second securing means for releasably securing the prongs of a male electrical plug to said female electrical contact; and second actuating means for selectively actuating said second securing means whereby said male electrical plug may be positively connected to said female electrical contact so that said securing means resists inadvertent disconnection of said male electrical plug during normal use.

3. The adapter as recited in claim 2, wherein said second securing means further comprises at least one retaining element made of electrically conducting material, said second actuating means operable to move said retaining element between an open position wherein said male electrical plug can be freely inserted into said female electrical contact and a closed position wherein said male electrical plug is secured therein.

4. The adapter as recited in claim 1, further comprising:

a ground connector; and pivot means connecting said ground connector to said housing, said pivot means allowing a user to move said ground connector between a first position wherein said ground connector projects outwards from said housing and a second position wherein said ground connector is adjacent to said housing.

5. A locking electrical adapter for releasably securing an electrical plug to an electrical receptacle, said adapter comprising:

a housing of electrically non-conducting material;

a male electrical contact held in said housing;

a spring assembly operably connected to said male electrical contact, said spring assembly having a closed position wherein said spring assembly substantially engages said male electrical contact and an open position wherein at least a portion of said spring assembly is spaced apart from said male electrical contact;

first actuating means for selectively moving said spring assembly between said open position and said closed position, whereby said male electrical contact may be inserted into said receptacle when said spring assembly is in said closed position and positively connected to said receptacle by said spring assembly in said open position, said spring assembly resisting inadvertent disconnection of said male electrical contact during normal use;

a female electrical contact held in said housing;

a retainer operably connected to said female electrical contact; and second actuating means for selectively moving said retainer from an open position wherein the prongs of a male electrical plug may be inserted into said female electrical contact to a closed position wherein said retainer resists inadvertent disconnection of said male electrical plug during normal use.

6. The adapter as recited in claim 5, wherein said male electrical contact further comprises a first prong and a second prong, said first and second prongs made of electrically conducting material, and wherein said spring assembly further comprises:

a first spring operably connected to said first prong; and a second spring operably connected to said second prong.

7. The adapter as recited in claim 5, wherein said male electrical contact further comprises a first prong and a second prong, said first and second prongs made of electrically conducting material, wherein said receptacle has first and second slots configured for receiving said first and second prongs, respectively, and wherein said spring assembly further comprises:

a first spring operably connected to said first prong, said first spring having at least one tip configured to engage an edge of said first slot when said first spring is in said open position; and a second spring operably connected to said second prong, said second spring having at least one tip configured to engage an edge of said second slot when said second spring is in said open position.

8. The adapter as recited in claim 5, wherein said first actuating means further comprises a first slide block operably connected to said spring assembly, said first slide block being mounted for reciprocal movement within a cavity in said housing, said first slide block operable by a user to selectively move said spring assembly between said open and said closed positions.

9. The adapter as recited in claim 5, wherein said retainer further comprises at least one electrically conducting retaining element held in said housing, said retaining element being selectively movable between said open and said closed positions.

10. The adapter as recited in claim 5, wherein said second actuating means further comprises a second slide block operably connected to said retainer, said second slide block being mounted for reciprocal movement within a cavity in said housing, said second slide block operable by a user to selectively move said retainer between said open and said closed positions.

11. The adapter as recited in claim 5, wherein said second actuating means further comprises a second slide block operably connected to said retainer, said second slide block being mounted for reciprocal movement within a cavity in said housing, said second slide block operable by a user to selectively move said retainer between said open and said closed positions, and wherein said housing has means formed therein for securing said second slide block in a selected position.

12. The adapter as recited in claim 5, further comprising a ground connector operably connected said housing, said ground connector providing positive electrical connection between a ground connector in said receptacle and a ground connector in said male electrical plug.

13. The adapter as recited in claim 5, further comprising:

a ground connector; and pivot means connecting said ground connector to said housing, said pivot means allowing a user to move said ground connector between a first position wherein said ground connector projects outwards from said housing and a second position wherein said ground connector is adjacent to said housing.

14. A locking electrical adapter, said adapter comprising:

a housing of electrically non-conducting material;

a male electrical contact held in said housing;

first securing means for securing said electrical contact to a female electrical contact, said first securing means including at least one spring operably connected to said male electrical contact, said at least one spring having a closed position wherein said spring engages said male electrical contact and an open position wherein at least a portion of said spring is spaced apart from said male electrical contact;

first actuating means for selectively actuating said first securing means whereby said electrical contact may be positively connected to said next electrical contact so that said first securing means resists inadvertent disconnection of said electrical contact during normal use;

a female electrical contact;

second securing means for releasably securing the prongs of a male electrical plug to said female electrical contact; and second actuating means for selectively actuating said second securing means whereby said second securing means resists inadvertent disconnection of said male electrical plug during normal use.

15. The adapter as recited in claim 14, wherein said second securing means further comprises at least one retaining element made of electrically conducting material, said second actuating means operable to move said retaining element between an open position wherein said male electrical plug can be freely inserted into said female electrical contact and a closed position wherein said male electrical plug is secured therein.

16. The adapter as recited in claim 14, further comprising:

a ground connector; and pivot means connecting said ground connector to said housing, said pivot means allowing a user to move said ground connector between a first position wherein said ground connector projects outwards from said housing and a second position wherein said ground connector is adjacent to said housing.

17. The adapter as recited in claim 1, wherein said end of at least one of said first and second springs includes a hooked tip.

18. The adapter as recited in claim 2, further comprising means for electrically connecting said male electrical contact and said female electrical contact.

19. The adapter as recited in claim 5, wherein said first and second actuating means are operable independently of each other.

20. The adapter as recited in claim 14, wherein said female electrical contact is held in said housing.

21. The adapter as recited in claim 14, further comprising a second housing holding said female electrical contact.

22. The adapter as recited in claim 14, further comprising cable means connecting said male electrical contact and said female electrical contact.

* * * * *